US008605000B2

(12) United States Patent
Li et al.

(10) Patent No.: US 8,605,000 B2
(45) Date of Patent: Dec. 10, 2013

(54) ANTENNA MOUNTING STRUCTURE OF ELECTRONIC DEVICE

(75) Inventors: Hong Li, Shenzhen (CN); Ke-Hui Peng, Shenzhen (CN); Li-Ni Liang, Shenzhen (CN); Ren-Wen Wang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 266 days.

(21) Appl. No.: 13/220,814

(22) Filed: Aug. 30, 2011

(65) Prior Publication Data

US 2012/0306704 A1 Dec. 6, 2012

(30) Foreign Application Priority Data

Jun. 1, 2011 (CN) ..... 2011 1 0145723

(51) Int. Cl.
*H01Q 1/42* (2006.01)
*H01Q 1/12* (2006.01)

(52) U.S. Cl.
USPC ..... 343/872; 343/892; 343/702

(58) Field of Classification Search
None
See application file for complete search history.

(56) References Cited

U.S. PATENT DOCUMENTS

| | | | | |
|---|---|---|---|---|
| 6,333,714 | B1 * | 12/2001 | Takahashi | 343/700 MS |
| 6,342,860 | B1 * | 1/2002 | Haussler et al. | 343/702 |
| 6,346,914 | B1 * | 2/2002 | Annamaa | 343/700 MS |
| 6,445,358 | B2 * | 9/2002 | Takahashi et al. | 343/828 |
| 6,972,721 | B2 * | 12/2005 | Park | 343/702 |
| 7,499,000 | B2 * | 3/2009 | Chan et al. | 343/872 |
| 7,911,399 | B2 * | 3/2011 | Yang et al. | 343/702 |
| 8,472,203 | B2 * | 6/2013 | Dabov et al. | 361/753 |
| 2008/0309564 | A1 * | 12/2008 | Booth et al. | 343/702 |
| 2011/0188225 | A1 * | 8/2011 | Wang et al. | 361/807 |
| 2012/0176277 | A1 * | 7/2012 | Malek et al. | 343/702 |

* cited by examiner

*Primary Examiner* — Trinh Dinh
(74) *Attorney, Agent, or Firm* — Altis Law Group, Inc.

(57) ABSTRACT

An antenna mounting structure of an electronic device includes a casing and an antenna in the casing. The antenna includes a signal receiving portion and a first securing member connecting the signal receiving portion. The first securing member defines a through hole. The casing includes a first pin, a first catch near the first pin, and a first rib extending from the first pin. The first pin extends through the through hole of the first securing member of the antenna. The first rib supports the first securing member. The first catch fixedly clasps the first securing member on the first pin and the first rib.

15 Claims, 4 Drawing Sheets

ANTENNA MOUNTING STRUCTURE OF ELECTRONIC DEVICE

CROSS-REFERENCE TO RELATED APPLICATION

This application claims priority under 35 U.S.C. 119 from China Application No. 201110145723.7 filed on Jan. 06,2011, the contents of which are incorporated herein by reference in their entirety.

BACKGROUND

1. Technical Field

The present disclosure relates to antenna mounting structures and, more particularly to an antenna mounting structure fixing an antenna in an electronic device.

2. Description of Related Art

Many electronic devices have wireless communication functions and may include an antenna. The antenna is mounted in a casing of an electronic device. A fastener, such as a screw extends through the antenna and the casing, fixing the antenna in the electronic device. However, both the disassembling and assembling require rotating the screws with a screwdriver. Such an unscrewing or screwing operation is laborious and time consuming.

Therefore, what is needed is an antenna mounting structure of an electronic device, which can overcome the above described shortcomings.

DETAILED DESCRIPTION

Figure 1:
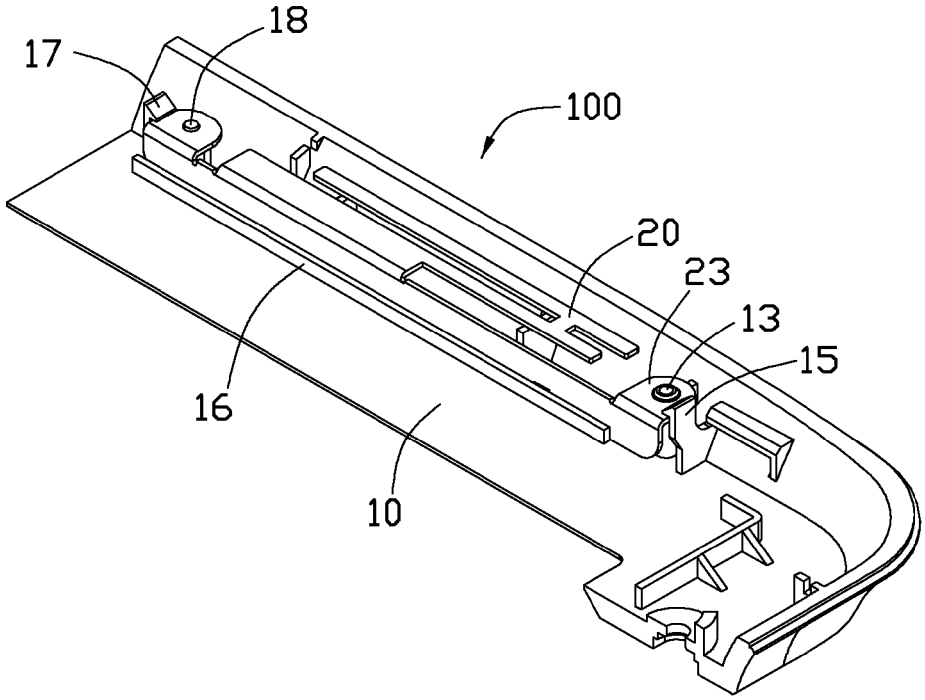
FIG. 1 is an assembled, isometric view of an antenna mounting structure in accordance with a first embodiment of the disclosure.

Referring to FIG. 1, an antenna mounting structure 100 of an electronic device according to a first embodiment of the present disclosure is shown. The electronic device can be, for example, a portable DVD player, a notebook computer or a projector. The antenna mounting structure 100 includes a casing 10 and an antenna 20.

Figure 2:
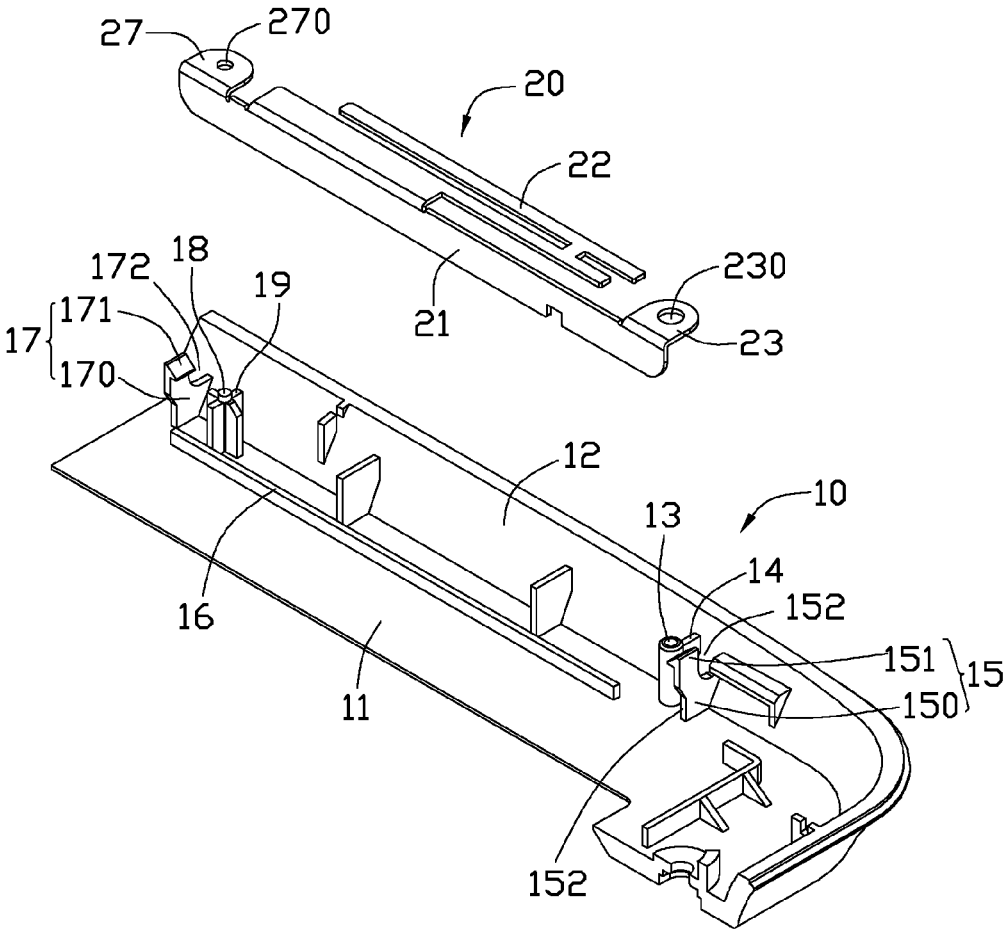
FIG. 2 is an exploded view of the antenna mounting structure of FIG. 1.

Referring also to FIG. 2, the casing 10 includes a bottom wall 11 and a sidewall 12 extending from the bottom wall 11. The bottom wall 11 forms a first pin 13 and a second pin 18 near the sidewall 12. Spaced from the sidewall 12 the first pin 13 and the second pin 18 extend perpendicularly from the bottom wall 11. A first rib 14 connects the first fin 13 with the sidewall 12. A height of the first rib 14 is slightly less than that of the first pin 13. A plurality of second ribs 19 radially extends from the second pin 18. One of the second ribs 19 connects the second pin 18 with the sidewall 12. A height of each second rib 19 is slightly less than that of the second pin 18.

A first catch 15 extends upwards from the bottom wall 11 at an outside of the first pin 13. A second catch 17 extends upwards from the bottom wall 11 at an outside of the second pin 18 and opposite to the first catch 15. The first catch 15, the first pin 13, the second pin 18 and the second catch 17 are substantially collinear and arranged in sequence. The first catch 15 and the second catch 17 are substantially the same.

The first catch 15 includes an elastic arm 150 and a buckling portion 151 extending from a top end of the elastic arm 150. The elastic arm 150 extends upwards and perpendicularly from the bottom wall 11 and connects the sidewall 12. The elastic arm 150 defines a gap 152 between the buckling portion 151 and the sidewall 12 thereby improving the elasticity of the elastic arm 150. The buckling portion 151 extends toward the first pin 13 to mount the antenna 20 on the first pin 13. The bucking portion 151 is located at a side of the antenna 20 and faces the first rib 14. The buckling portion 151 has an included top surface to guide the antenna 20 onto the first pin 13. The second catch 17 includes an elastic arm 170 and a buckling portion 171 extending from a top end of the elastic arm 170. The elastic arm 170 extends upwards and perpendicularly from the bottom wall 11 and connects to the sidewall 12. The elastic arm 170 defines a gap 172 between the buckling portion 171 and the sidewall 12 thereby improving the elasticity of the elastic arm 170. The buckling portion 171 extends toward the second pin 18 to mount the antenna 20 on the second pin 18. The buckling portion 171 has an included top surface to guide the antenna 20 onto the second pin 18. A block wall 16 extends upwards from the bottom wall 11 at the inside of the first and second pins 13, 18 and spaces from the first and second pins 13, 18. The block wall 16 is elongated and parallel to a line defined by the first and second pins 13, 18.

The antenna 20 is a built-in antenna in the electronic device and connects to a circuit board of the electronic devices via wires. The antenna 20 is made of metal. The antenna 20 includes a signal receiving portion 22, a first securing portion 23, a second securing portion 27, and a lateral plate 21. The first securing member 23 and the second securing member 27 extend perpendicularly from opposite ends of the lateral plate 21 respectively along a same direction. The signal receiving portion 22 connects the lateral plate 21 and is located between the first securing member 23 and the second securing member 27. A fixing hole 230 is defined in the center of the first securing member 23. Another fixing hole 270 is defined in the center of the second securing member 27. The height of the lateral plate 21 is the same as the height of each of the first rib 14 and the second rib 19.

In assembly, the antenna 20 is mounted onto the first pin 13 and the second pin 18. The first and second catches 15, 17 respectively extend the first pin 13 and the second pin 18 outwards away from the first and second securing members 23, 27. The first pin 13 and the second pin 18 respectively insert into the fixing hole 230 of the first securing member 23 and the fixing hole 270 of the second securing member 27. The lateral plate 21 is inserted between the block wall 16 and the first and second pins 13. At the same time, the first rib 14 and the second rib 19 support the first securing member 23 and the second securing member 27. The first and second catches 15, 17 return to lock the antenna 20 on the first pin 13 and the second pin 18.

In disassembly, the first and second catches 15, 17 are pushed outwards to disengage the antenna 20. Then the antenna 20 is easily withdrawn from the casing 10. In addition, each of the elastic arms 150, 170 defines the gap 152, 172 thereby improving elasticity of the first and second catches 15, 17, and providing space for extension of the wires connecting the signal receiving portion 22.

Figure 3:
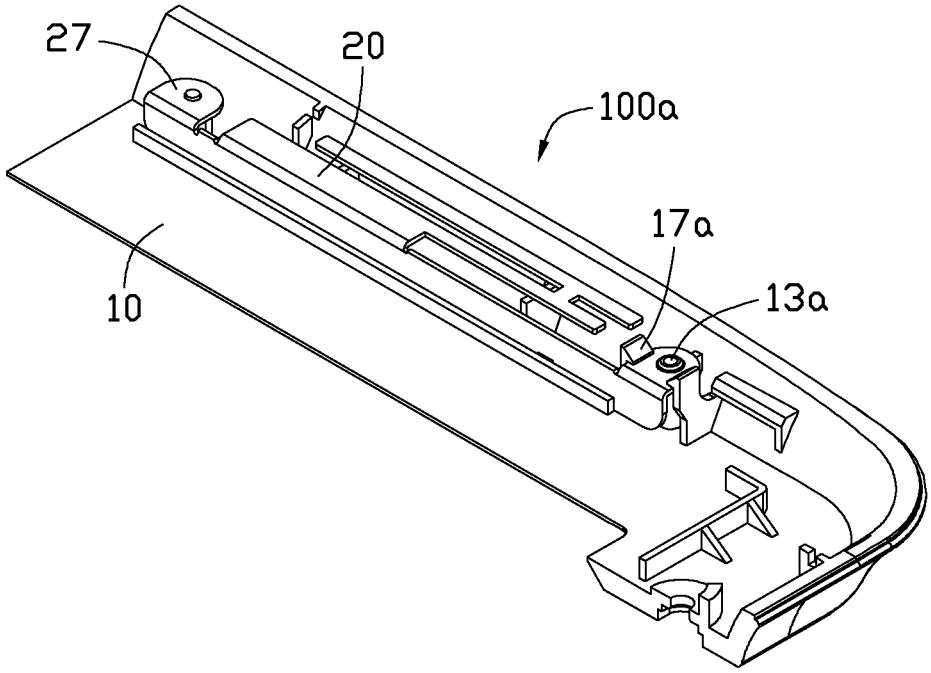
FIG. 3 is an assembled, isometric view of an antenna mounting structure in accordance with a second embodiment of the disclosure.
Figure 4:
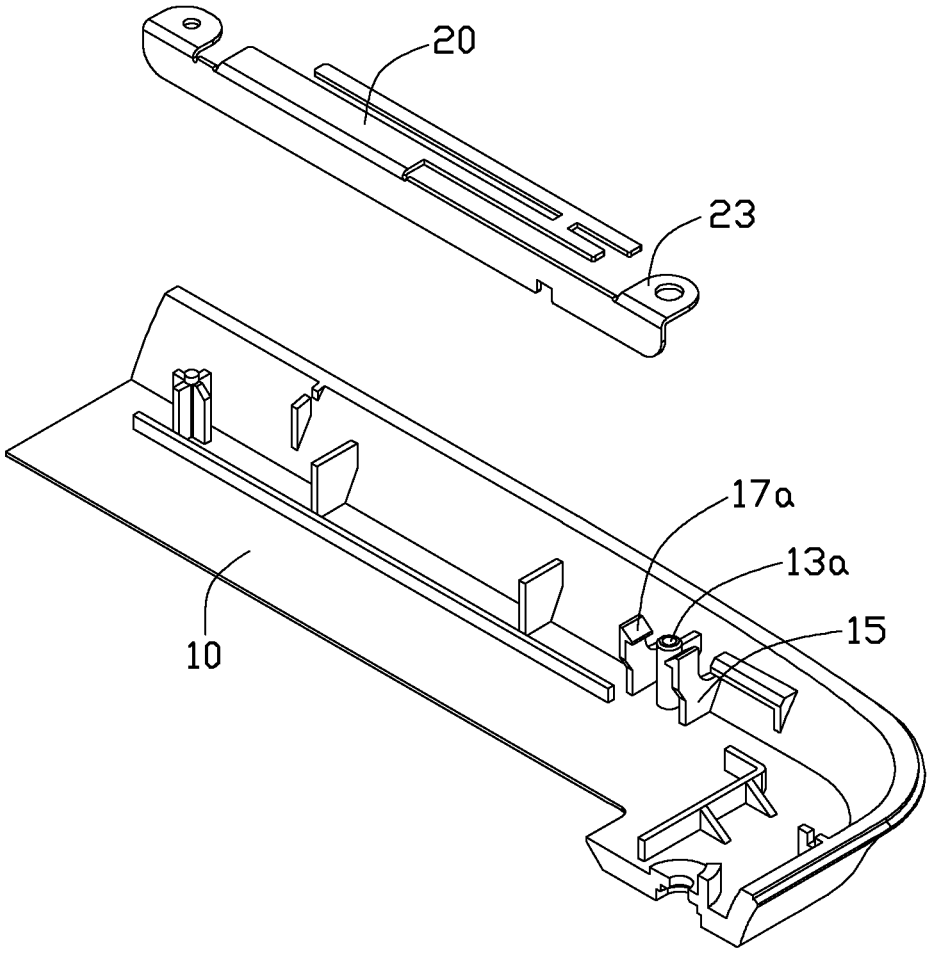
FIG. 4 is an exploded view of the antenna mounting structure of FIG. 3.

Referring to FIGS. 3-4, an antenna mounting structure 100*a* in accordance with a second embodiment of the disclosure is shown. Different from the antenna mounting structure

100 of the first embodiment, the antenna mounting structure 100*a* includes a second catch 17*a* located at a side of the first pin 13 opposite to the first catch 15. The first catch 15 and the second catch 17*a* cooperatively mount the first securing portion 23 of the antenna 20 on the first pin 13.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. An antenna mounting structure of an electronic device, the antenna mounting structure comprising:

an antenna comprising a signal receiving portion and a first securing member connecting the signal receiving portion, the first securing member defining a through hole therein; and a casing comprising a first pin, a first catch near the first pin, and a first rib extending from the first pin, the first pin extending through the through hole of the first securing member of the antenna, the first rib supporting the first securing member, the first catch fixedly clasping the first securing member on the first pin and the first rib.

2. The antenna mounting structure of claim 1, wherein the casing further comprises a bottom wall and a sidewall connecting the bottom wall, the first pin and the first catch extending from the bottom wall, the first rib connecting the first pin and the sidewall.

3. The antenna mounting structure of claim 2, wherein the first catch comprises an elastic arm extending from the bottom wall and a buckling portion extending from a top end of the elastic arm, the buckling portion facing the first pin.

4. The antenna mounting structure of claim 3, wherein the elastic arm of the first catch connects the sidewall and defines a gap for extension of wires.

5. The antenna mounting structure of claim 1, wherein the antenna further comprises a lateral plate, the first securing member and the signal receiving portion extending perpendicularly from the lateral plate.

6. The antenna mounting structure of claim 5, wherein the casing further comprises a block wall, the lateral plate of the antenna being sandwiched between the block wall and the first pin.

7. The antenna mounting structure of claim 1, wherein the casing further comprises a second catch cooperatively clasping the first securing member of the antenna on the first pin.

8. An antenna mounting structure of an electronic device, the antenna mounting structure comprising:

an antenna comprising a first securing member, a second securing member, and a signal receiving portion connecting the first securing member and the second securing member, each of the first securing member and the second securing member defining a through hole therein; and a casing comprising a first pin, a first catch near the first pin, a second pin, and a second catch near the second pin, a top end of the first pin extending through the through hole of the first securing member, the first catch fixedly clasping the first securing member on the first pin, a top end of the second pin extending through the through hole of the second securing member, the second catch fixedly clasping the second securing member on the second pin thereby mounting the antenna on the casing.

9. The antenna mounting structure of claim 8, wherein the casing further comprises a bottom wall and a sidewall connecting the bottom wall, the first pin, the second pin, the first catch, and the second catch extending from the bottom wall, a first rib connecting the first pin and the sidewall and supporting the first securing member, a second rib connecting the second pin and the sidewall and supporting the second securing member.

10. The antenna mounting structure of claim 9, wherein the first catch comprises an elastic arm extending from the bottom wall and a buckling portion extending from a top end of the elastic arm, the buckling portion facing the first pin.

11. The antenna mounting structure of claim 10, wherein the elastic arm of the first catch connects the sidewall and defines a gap for extension of wires.

12. The antenna mounting structure of claim 9, wherein the second catch comprises an elastic arm extending from the bottom wall and a buckling portion extending from a top end of the elastic arm, the buckling portion facing the second pin.

13. The antenna mounting structure of claim 8, wherein the antenna further comprises a lateral plate, the first securing member, the second securing member and the signal receiving portion extending perpendicularly from the lateral plate.

14. The antenna mounting structure of claim 13, wherein the casing further comprises a block wall, the lateral plate of the antenna being sandwiched between the block wall and the first and second pins.

15. An antenna mounting structure of an electronic device for fixing an antenna with a through hole thereon, the antenna mounting structure comprising:

a first pin having a top end for extending through the through hole of the antenna;

a first rib extending from the first pin, the first rib being adapted for supporting the antenna at a periphery of the through hole; and a first catch comprising an elastic arm and a buckling portion extending from the elastic arm, the buckling portion clasping the antenna on the first pin and the first rib, the buckling portion being at a side of the antenna and facing the first rib.

* * * * *